United States Patent [19]

Burtelson

[11] Patent Number: 4,756,130

[45] Date of Patent: Jul. 12, 1988

[54] APPARATUS FOR REINFORCING UTILITY POLES AND THE LIKE

[75] Inventor: Frederick W. Burtelson, Harvard, Ill.

[73] Assignee: Joslyn Corporation, Chicago, Ill.

[21] Appl. No.: 76,493

[22] Filed: Jul. 22, 1987

[51] Int. Cl.[4] ..... E02D 5/74

[52] U.S. Cl. ..... 52/170

[58] Field of Search ..... 52/169.13, 170, 728, 52/165

[56] References Cited

U.S. PATENT DOCUMENTS 1,679,747 8/1928 Spring ..... 52/170

3,738,072 6/1973 Adrian ..... 52/170

*Primary Examiner*—John E. Murtagh

*Attorney, Agent, or Firm*—Mason, Kolehmainen, Rathburn & Wyss

[57] ABSTRACT

A new and improved utility pole reinforcement system includes an elongated pole splint driven into the ground adjacent the pole and having contact surfaces adapted to engage and support the surface thereof. The splint includes a structural body spaced outwardly of the pole providing increased resistance to stress applied to the pole. A pair of brackets are spaced apart longitudinally on the body portion of the splint, each bracket having opposite end portions extending laterally outwardly and a tension strap assembly for binding the pole and splint together is connected to opposite end portions of each bracket. Each strap assembly includes at least one elongated strap of relatively thin flexible material conforming generally to the surface of the pole and formed with a plurality of longitudinally spaced apart apertures. Clips are provided for supporting threaded elements for connecting the clips and the bracket end portions and each clip includes a pair of hook elements designed to seat in hooked engagement within selected apertures in the flexible strap so as to be readily adjustable to provide for poles of varying diameters.

25 Claims, 3 Drawing Sheets

FIG. 1
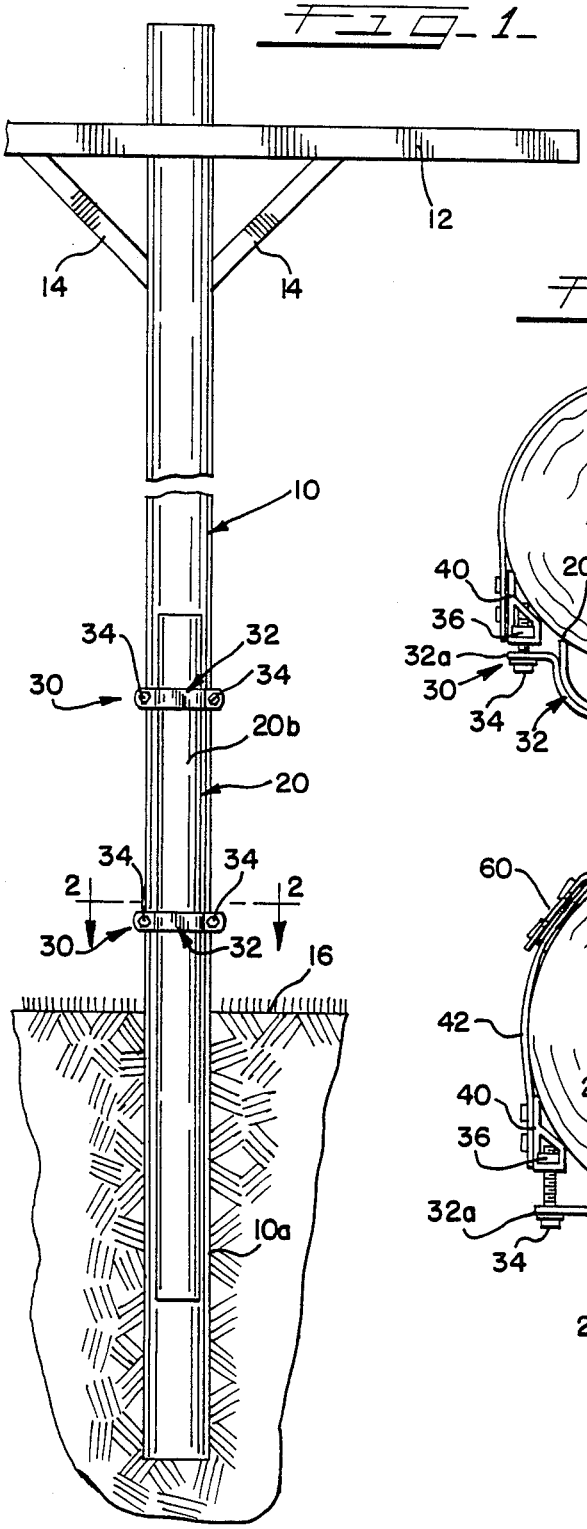
FIG. 2
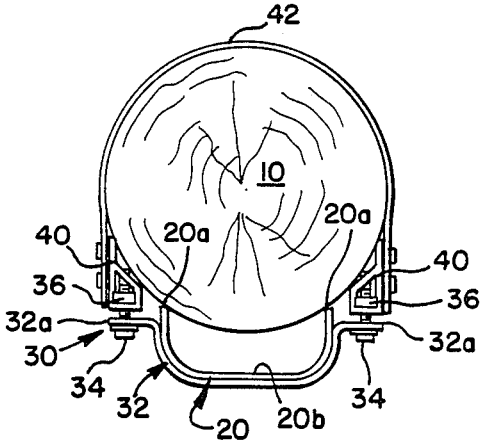
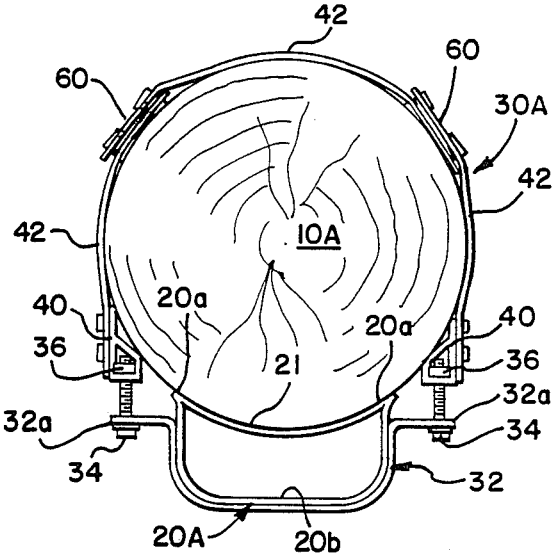
FIG. 3

FIG. 4
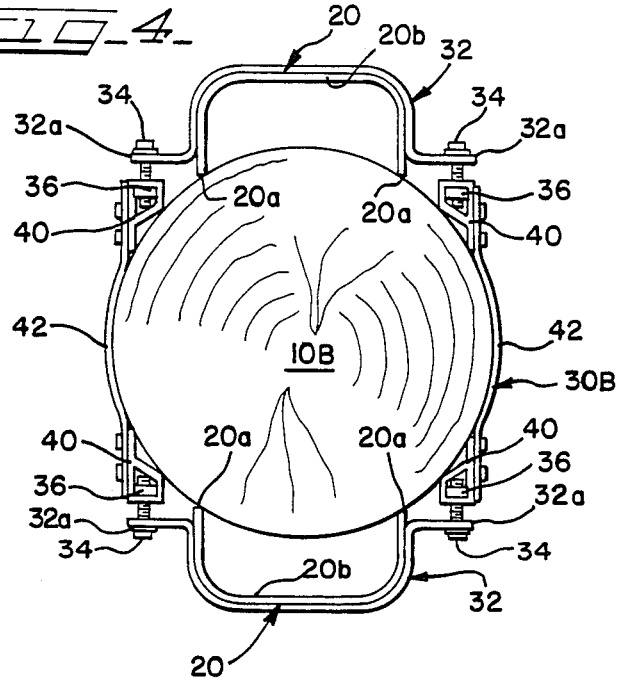
FIG. 5
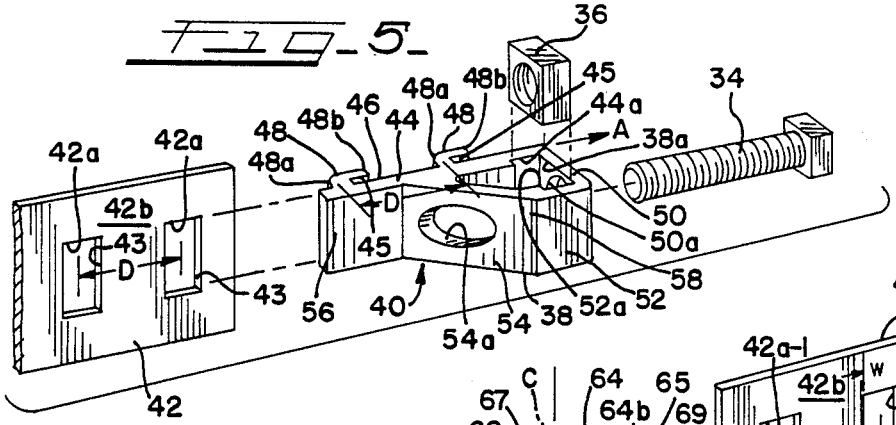
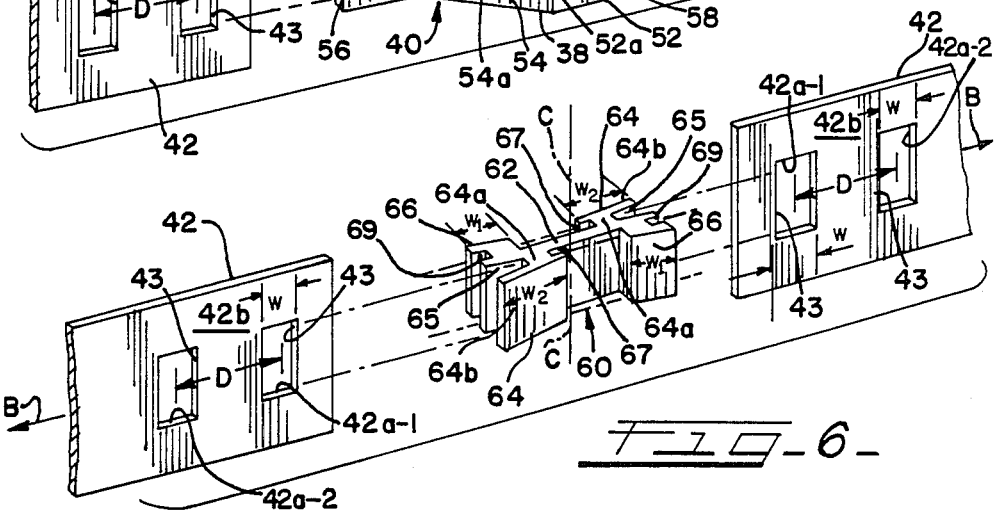
FIG. 6

APPARATUS FOR REINFORCING UTILITY POLES AND THE LIKE

BACKGROUND OF THE INVENTION

1. Field of the Invention

The present invention relates to a new and improved apparatus for reinforcing utility poles and the like and more particularly to a utility pole reinforcement system employing an elongated metal pole splint adapted to be driven into the ground adjacent the pole and secured thereto by novel tension strap assemblies which are adjustable in length to accommodate poles of varying different diameters.

2. Background of the Prior Art

Utility companies have found that it is cost effective to reinforce rather than replace utility poles which have been overstressed, weakened or damaged and a need exists for providing a universal system for reinforcing utility poles to provide an extended term of useful service before actual pole replacement is necessary.

U.S. Pat. No. 1,561,193 discloses a pole reinforcement system employing reinforcing members of complex cross-sectional shape and a pair of bent clamping rods, and U.S. Pat. No. 1,995,874 discloses a pole reinforcement system employing pairs of elongated angles which are lag-screwed to the pole and connected by curved bolts.

U.S. Pat. No. 3,309,824 discloses a metal strapping arrangement for banding a reinforcing member to a pole, and U.S. Pat. No. 3,350,822 discloses a steel reinforcer of special shape banded to the pole with steel strapping members.

U.S. Pat. No. 3,362,124 discloses a method of reinforcing deteriorated sections of timber with a resin filler and metal cover plate, and U.S. Pat. No. 3,475,874 discloses a pole reinforcing system employing elongated rods in helical array around the pole.

U.S. Pat. No. 3,738,072 discloses pole reinforcing apparatus employing a flexible strap with nuts secured at opposite ends for receiving bolts for securing a pole splint in place. However, the pole reinforcing apparatus therein disclosed is only useful with poles of a limited diameter range in sizes for a flexible tension strap of given length.

OBJECTS OF THE PRESENT INVENTION

It is an object of the present invention to provide a new and improved apparatus for reinforcing utility poles and the like and more particularly a new and improved utility pole reinforcement system designed to accommodate a wide range of pole diameters.

Another object of the present invention is to provide a new and improved universal utility pole reinforcement system wherein the length of a tension strap assembly may be readily adjusted as needed to accommodate a wide range of pole sizes and wherein such accommodation can be accomplished in the field without requiring specialized components.

Still another object of the present invention is to provide a new and improved utility pole reinforcement system of the character described employing a tension strap assembly having a novel clip adapted to hold and support a threaded element and adapted to be mounted in hooked engagement at a plurality different longitudinal positions on a thin flexible tension strap of given length in order to accommodate poles of variable diameter.

Yet another object of the present invention is to provide a new and improved utility pole reinforcement system of the character described employing a universal strap assembly which is adjustable in effective length to accommodate poles of different diameter and which includes a novel splicer for interconnecting a pair of tension straps, each strap in hooked engagement with the splicer element.

Yet another object of the present invention is to provide a new and improved utility pole reinforcement system wherein the total number of components required to satisfy a wide range of pole diameters is greatly reduced in comparison to systems heretofore known.

Yet another object of the present invention is to provide a new and improved utility pole reinforcement system of the character described which is highly versatile and universal in nature so that a wide range of pole diameters can be accommodated.

Another object of the present invention is to provide a new and improved utility pole reinforcement system of the character described which is easy to install and which is relatively low in cost in comparison to pole reinforcing systems heretofore available.

BRIEF SUMMARY OF THE INVENTION

The foregoing objects and advantages of the present invention are accomplished in an illustrated embodiment herein comprising a novel utility pole reinforcing system which includes an elongated metal pole splint adapted to be driven into the ground adjacent the pole and provided with a pole contact surface area adapted to engage and support the adjacent surface of the pole when the splint is in place. The splint includes a structural body spaced outwardly of the pole contact area so as to provide additional reinforcement to resist stress applied to the pole. A plurality of brackets are spaced apart longitudinally of the splint body and each bracket has opposite end portions extending laterally outward of the splint. A tension strap assembly is provided for interconnecting opposite ends of each bracket and securing or binding the elongated pole splint tightly against the surface of the pole. Each tension strap assembly includes at least one elongated strap of relatively thin flexible sheet material having a plurality of longitudinally aligned apertures provided at equally spaced intervals therein. A universal clip is connected to the strap and includes a hook element adapted to seat within a particular selected aperture or pair of adjacent apertures provided in the strap so as to form a strap assembly with an effective length that is suitable for the diameter of a particular utility pole that is being reinforced. Each clip is designed to support a threaded nut therein and an elongated threaded bolt is interconnected between the nut and the adjacent end portion of a bracket on the splint so as to exert the necessary tension force applied by the tension strap assembly to secure and hold the pole splint tightly against the pole. The strap assembly may also include a novel splicer for interconnecting a pair of flexible straps when needed for larger diameter poles and thus the system provides for the reinforcement of utility poles having a wide range of pole diameters yet requires only a minimal number of standard size components in a complete and universal pole reinforcement system.

BRIEF DESCRIPTION OF THE DRAWINGS

For a better understanding of the present invention, reference should be had to the following detailed description taken in conjunction with the drawings, in which:

FIG. 1 is an elevational view of a typical utility pole with a pole reinforcing apparatus constructed in accordance with the present invention secured thereto;

FIG. 2 is a horizontal transverse cross-sectional view taken substantially along lines 2—2 of FIG. 1;

FIG. 3 is a horizontal transverse cross-sectional view similar to FIG. 2 but illustrating the pole reinforcing system of the present invention applied to a utility pole of greater diameter;

FIG. 4 is a horizontal transverse cross-sectional view similar to FIGS. 2 and 3 but illustrating a utility pole with a pair of splints applied to opposite surfaces thereof in accordance with the utility pole reinforcement system of the present invention;

FIG. 5 is a fragmentary, exploded, perspective view of a portion of a new and improved tension strap assembly in accordance with a feature of the present invention including a tension strap, clip, nut and bolt; and FIG. 6 is a fragmentary perspective view of a portion of a tension strap assembly in accordance with a feature of the present invention illustrating a novel splicer element as utilized for interconnecting a pair of tension straps.

DESCRIPTION OF A PREFERRED EMBODIMENT

Figure 6A:
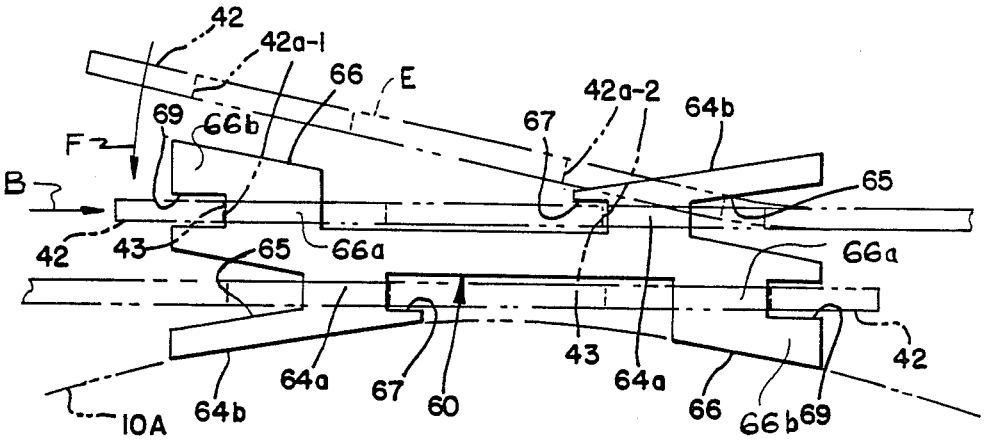
FIG. 6A is an enlarged top plan view of the splicer element with a pair of interconnected straps shown in dotted lines.

Referring now particularly to the drawings, in FIG. 1 is illustrated a typical utility pole 10 having a cross arm 12 adjacent an upper end portion and diagonal cross braces 14. The pole includes a lower portion 10*a* extending downwardly below the ground level 16 and usually a region on the pole immediately adjacent the ground level is the region most often affected by high stress, damage or other forms of deterioration which cause the need for a pole reinforcement system to be utilized in lieu of replacement of the entire pole and the attendant high cost thereof.

In accordance with the present invention, an elongated pole splint 20 of generally channel-shaped transverse cross-section, FIGS. 2, 3 and 4, formed of metal, preferably treated for weather and corrosion-resistance is driven into the ground closely adjacent the pole so that longitudinally extending surfaces 20*a* thereof are in confronting contacting engagement with the surface of the pole along a substantial length thereof both above and below the ground level 16. The pole splint includes an intermediate body portion 20*b* or channel-shaped web spaced outwardly away from the edges or contact surfaces 20*a* in order to provide a composite pole and splint cross-section modulus of the desired strength to adequately resist bending, shear, torsion, compression and other stresses applied to the pole.

Depending upon the height of a utility pole and the diameter, the pole splints 20 may be fabricated out of metal having a variety of different thicknesses and lengths so as to provide the needed amount of pole reinforcement strength. Most of the pole splints utilized have a generally channel-shaped transverse cross section, however, reference should be had to FIG. 3 wherein a pole splint 20A of modified tubular cross-section is used for providing increased reinforcing strength for a pole 10A of relatively large diameter. The pole splint 20A includes a curved continuous inner wall 21 which provides a wide area of surface contact greater than the relatively narrow spaced apart contact areas 20*a* running along opposite edges of the pole splints 20. The modified splint 20A also may have a body portion or web 20*b* which is spaced a somewhat greater distance away from the pole surface than the web 20*b* of the more conventional, channel-shaped pole splints 20 of FIGS. 2 and 4. Moreover in particular circumstances, rather than a larger, heavier pole splint of the type shown in FIG. 3, it may be desirable to strengthen and reinforce a large diameter pole 10B (FIG. 4) with a plurality of channel-shaped pole splint 20 disposed on opposite sides of the pole surface.

In general, the pole splints 20 and 20A are formed of relatively heavy gauge sheet material or steel plate with roll-formed cross-sectional shapes as shown and the metal surface is galvanized or otherwise treated for weather and corrosion resistance because a lower portion of the splint is normally inserted into the ground while an upper half portion is exposed to the atmosphere. This environment often results in relatively high corrosive action on the pole splint and on the pole 10 itself in the region immediately adjacent the ground level 16.

In accordance with the present invention, after a pole splint 20 is driven into the ground adjacent the pole 10 with the edges 20*a* in contact with the surface of the pole as shown in FIGS. 1 and 2, at least one pair of upper and lower strap assemblies 30 are provided to bind the splint and the pole tightly together to thereby increase the composite section modulus to resist deflection and bending stresses applied against the pole and supported structure by wind, weather and the equipment and lines connected thereto.

Each strap assembly 30 includes a generally U-shaped, bracket 32 having a profile designed to match the outer surface of the splint 20 as shown in FIG. 2 and including a pair of opposite end portions 32*a* extending laterally outwardly (horizontally) in opposite directions from opposite sides of the splint. Each bracket end portion is formed with a circular aperture to accommodate a headed tension bolt 34. The tension bolts 34 extend through the apertures in the bracket ends 32*a* and are threadedly engaged in captivated nuts 36 mounted in a socket forming body structure 38 of specially designed connector clips 40. Preferably the clips are formed of aluminum or other corrosion resistant material in an extrusion process and each is mounted in adjustable hooked engagement to an elongated, flexible tension strap 42 encircling a backside of the pole 10 opposite the pole splint 20 to complete the strap assembly 30.

The elongated straps 42 may be provided in several different thicknesses and widths as required depending upon a particular application and also may be cut to appropriate lengths in the field. Preferably, the tension straps are sized in modular lengths that are most commonly utilized. Each strap 42 is preferably treated with a corrosion resistant process such as galvanizing and/or anodizing.

In accordance with the present invention, each strap is formed with a plurality of longitudinally spaced apart, openings or apertures 42*a* preferably of rectangular shape as illustrated and the apertures are aligned along a longitudinal center axis of the strap. Preferably, the holes or apertures 42a are formed in a stamping or punching operation and are located at equally spaced intervals (distance D —FIG. 6) in series along a longitudinally aligned central axis of the strap. The interval or center to center spacing between any two adjacent punched apertures 42a is the same taken anywhere along the entire length of the strap and the straps are dimensioned in length to provide a particular number of apertures which will accommodate most of the pole diameters usually encountered in the field.

In accordance with an important feature of the present invention, the connector clips 40 are formed with an elongated rectangular base 44 having a generally flat surface 46 on one side adapted to engage an adjacent surface or face 42b of a tension strap 42 as illustrated in FIG. 3. Each clip includes a plurality of integrally formed hook elements 48 protruding outwardly from the surface 46 and spaced apart longitudinally at an interval "D" which is equal to the spacing interval between the punched opening 42a on the tension straps 42. Each hook element includes a short leg 48a at right angles to the surface 46 and an outer leg 48b joined thereto and extending parallel and spaced apart outwardly from the surface 46. This arrangement permits a clip 40 to be mounted in hooked engagement on a strap with the pair of hook elements 48 of the clip passing through any selected pair of adjacent apertures 42a along the length of the strap as desired. Once the hook elements are passed through a selected pair of apertures in the strap, the clip is moved longitudinally in the direction of the arrow A relative to the strap. This action firmly seats edge portions 43 of the apertures within a pair of recesses 45 on the clip formed by the hook elements 48 between the clip surface 46 and the inside faces of the outer hook legs 48b. This engagement holds the clip in a selected place along the length of the strap to transmit tension force between the clip and strap.

The body portion 38 of each clip comprises an apertured end wall 50 forming one side of a nut receiving recess 38a (FIG. 5) and the body portion also includes an outer wall section 52 parallel of the base 44. An inwardly sloping apertured opposite end wall 54 is joined between the base 44 the outer wall section 52. Apertures 50a and 54a in the respective end walls 50 and 54 are coaxially aligned to receive the threaded shank portion of a tension bolt 34 inserted into threaded engagement with a nut 36 contained in the recess 38a. If the threads of a nut are stripped or damaged, another nut can be readily substituted in place in the socket forming structure 38 of the clip. The base 44 and the outer wall 52 of the clip body 38 are provided with transversely extending grooves 44a and 52a on the inside surfaces to receive opposite edge portions of the square-shaped nut 36 and hold the nut in place while the threaded shank of the tension bolt 34 is inserted through the opening 50a to threadedly engage the bore of the nut. The somewhat oval-shaped opening 54a in the sloped wall 54 of the body portion 38 permits an outer end portion of the bolt to extend outwardly of the clip towards the adjacent surface of the pole when the bolt is tightened.

In accordance with an important feature of the present invention, the uniquely-shaped clips 40 are provided with longitudinally spaced, surface areas 56 and 58 on the base 44 and the socket forming body structure 38 respectively, and these surfaces are adapted to allow appropriate clearance between the clips 40 and the surface of the pole 10 when the bolts 34 are tightened in place to complete the assembly of the strap assemblies 30 and tightly bind the splint 20 to the shank of the utility pole. Preferably, a strap assembly 30 is provided to secure the splint and pole together at two or more different levels spaced above the ground level 16 as shown in FIG. 1.

Referring now to FIG. 3, when a pole 10A of somewhat greater size is being reinforced, it may be desirable to utilize a modified form of strap assembly 30A which employs three straps 42 of somewhat shorter modular length in comparison to the modular length of the single strap 42 as shown in FIG. 2. The shorter (modular) length straps 42 are easier to handle and less cumbersome to stock and store. Each pair of shorter straps is interconnected by a splicer 60 (FIGS. 3 and 6) constructed in accordance with the present invention and especially designed and adapted to interfit with the apertures 42a and edge portions 43 of the straps 42.

As viewed in FIG. 6, each splicer 60 is preferably formed of extruded aluminum or the like and has a unique cross-sectional shape as shown including an elongated body 62 and two (2) pair of oppositely outwardly extending somewhat T-shaped hook elements 64 and hook elements 66, respectively, at alternating opposite ends of the body 62 on opposite sides. As shown best in FIG. 6A, each hook element 64 and 66 includes a short leg 64a and 66a projecting outwardly at right angles from the body 62 and an outer leg 64b and 66b diverging angularly outwardly of the body at a relatively small angle. The legs 64b form throats or recesses 65 and 67 on opposite sides of the base 62 for receiving an edge portion 43 on the edge of an aperture 42a of an adjacent strap 42 hookingly engaged with the splicer 60. The legs 66b form a throat or recess 69 on opposite sides of the base 62, also, for receiving an edge portion 43 on the edge of an aperture 42a of an adjacent strap 42 hookingly engaged with the splicer 60.

The outer legs 64b and 66b on each side are uniquely designed with outer faces diverging angularly outwardly and having longitudinal widths $W_2$ and $W_1$, respectively. Outer surfaces of each pair of legs 64b and 66b on each side of the base 62 are aligned to be approximately tangent to the surface of the pole 10A as illustrated in FIG. 6A, and this provides a substantial area of contact between the splicer 60 and pole to minimize stress on the pole surface. The longitudinal width W of the apertures 42a in the straps 42 is smaller than the dimension $W_2$ and slightly larger than the dimension $W_1$.

To effect the attachment of a strap 42 to the splicer 60, the strap 42 is placed at a slight angle to splicer 60 as shown at "E" in FIG. 6A, and the second aperture 42a-2 from the end of the strap is engaged into throat or recess 65 until the first aperture 42a-1 from the end of the strap can be placed over the hook element 66. The strap 42 is then rotated toward a parallel orientation with splicer body 62 as indicated by an arrow F and is then moved in the direction indicated by arrow "B" until edge portion 43 in aperture 42a-1 is engaged into throat or recess 69; and, edge portion 43 in aperture 42a-2 is engaged into throat or recess 67.

It should be noted that a pair of straps 42 is interconnected with a splicer 60 in the manner described heretofore and the straps are mounted on opposite sides of the splicer body 62. Because the slots 42 have a width W that is greater than the face width $W_1$ of the outer leg 66*b* of hook element 66 and less than the face width $W_2$ of the outer leg **64*b* of hook element 64, the straps 42 are positively captured by the splicer 60 when engaged therewith by the process described. The outer legs 64*b* extend longitudinally of the base 62 in opposite directions from the joining short leg 64*a* to form the oppositely facing throats 65 and 67, whereas the outer legs 66*b* extend in only one direction longitudinally of the base beyond the joining short legs 66*a* to form the throat 69. Accordingly, on each side of the base 62, a pair of throats 67 and 69 face in one direction whereas only a single throat 65 faces in an opposite direction. Moreover, the throat 65 is larger to permit angular adjustment of the strap 42 while being engaged (E) with the hooks 64 and 66 as illustrated in FIG. 6A**.

Realizing that the straps are mounted on opposite sides of the splicer 60 so that when tension is exerted on the straps (as indicated by arrows "B") in opposite directions, a rotational torque is produced on the splicer about a vertical axis C—C at a mid point on the body 62. This torque is resisted by the outer surface of an outer leg **64*b* or an outer leg 66*b* of one splicer which presses against the surface of the pole. The diverging angularity of said outer legs approximate planes that are tangent to the outer surface of the pole. This arrangement provides for an equalized pressure contact between a splicer 60 and the pole at two longitudinally spaced locations along the splicer body to spread the load against the pole surface exerted by the strap assemblies 30A. The strap assemblies 30A thus permit the use of relatively short length (modular) tension straps 42 on large diameter poles 10A and any number of splicers 60** and pairs of connected straps as needed can be assembled to handle a pole of any particular size.

When a double splint arrangement as shown in FIG. 4, is to be utilized on a pole 10B, a modified form of strap assembly 30B is provided wherein relatively short (modular) length, flexible tension straps 42 are interconnected directly between pairs of clips 40 on opposite sides of the pole surface. A set of bolts 34 on opposite sides are tightened for securing each pair of clips on the same side of the pole to a common bracket 32.

From the foregoing, it will be seen that the utility pole reinforcement system of the present invention is cost effective to often eliminate the need for a complete pole replacement. The universal nature of the system provides a capability for handling a wide range of pole diameters that may be encountered in the field using straps of a relatively short modular length. A minimum number of components are required for each strap assembly and standardized clips, splicers and modular length straps permit the use of common bolts and nuts along with brackets matching the individual splints that are provided. The strap assemblies are easily assembled in the field and the unique clips 40 and double acting splicers 60 provide a commonality or universal nature which is helpful to field installation crews.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. A utility pole reinforcement system, comprising:

an elongated pole splint adapted to be driven into the ground adjacent said pole, said splint having an elongated pole contact surface adapted to engage and support the adjacent surface of said pole, and further including a structural body portion spaced outwardly of said pole contact surface for providing resistance to bending stress applied against said pole;

at least one pair of brackets spaced apart longitudinally of said body portion of said splint and having opposite end portions extending laterally outward thereof; and a tension strap assembly for holding said pole splint contact surface against said pole and connected to said opposite end portions of each of said brackets, each strap assembly including at least one elongated strap of relatively thin flexible sheet material having a plurality of longitudinally spaced apart apertures therein; and a clip for supporting a threaded element and including at least one projection dimensioned to seat in a selected aperture of said strap to provide a mechanical interconnection between said clip and strap for resisting tension force applied therebetween.

2. The utility pole reinforcement system of claim 1, wherein:

said clip includes a surface adapted to engage an adjacent face of said strap when interconnected therewith and wherein said projection comprises a hook element having a short leg extended outwardly of said surface through said selected aperture in said strap and an outer leg joining said short leg and extending along an opposite face of said strap spaced from said surface.

3. The utility pole reinforcement system of claim 2, wherein:

said clip includes a plurality of said projections spaced apart by a distance substantially the same as the distance between adjacent apertures in said strap for engaging a plurality of selected apertures adjacent one another to form said mechanical interconnection between said strap and clip at a selected position therebetween.

4. The utility pole reinforcement system of claim 2, wherein:

said outer leg of said clip extends generally parallel of said surface in a direction toward an end portion of said bracket.

5. The utility pole reinforcement system of claim 2, wherein:

said clip includes a socket structure extending outwardly of said opposite face for removably receiving and holding said threaded element.

6. The utility pole reinforcement system of claim 5, wherein:

said threaded element comprises nut means having a threaded bore aligned to receive an elongated threaded member extending toward an outer end portion of said bracket.

7. The utility pole reinforcement system of claim 6, wherein:

said clip includes at least a pair of pole contacting areas opposite said surface thereof, one of said areas being formed on said socket structure.

8. The utility pole reinforcement system of claim 7, wherein:

said socket structure of said clip includes apertured walls having aligned apertures therein for accommodating said elongated threaded member.

9. The utility pole reinforcement system of claim 8, wherein:

said socket structure includes open ended slot means defined adjacent an inside face of one of said apertured walls for receiving said nut means to be positioned therein with said threaded bore aligned with said apertures of said apertured walls.

10. The utility pole reinforcement system of claim 2, including:

at least one pair of said straps and a splicer for interconnecting adjacent ends thereof;

said splicer including an elongated body having opposite sides adapted to engage adjacent faces of said straps for connection therewith, said splicer including a hook element extending outwardly of each side of said body including a short leg dimensioned to seat in an aperture of an engaged strap and an outer leg joining said short leg and extending along an opposite face of said engaged strap for securing the same in hooked engagement on said splicer.

11. The utility pole reinforcement system of claim 10, wherein:

said splicer includes a pair of longitudinally spaced pole engaging surfaces on at least one side thereof.

12. The utility pole reinforcement system of claim 11, wherein:

at least one of said utility pole engaging surfaces comprises an outer surface on said outer leg of said hook element.

13. In a utility pole reinforcement system of the type including an elongated pole splint driven into the ground adjacent the pole and at least a pair of tension strap assemblies spaced longitudinally apart on said splint, each strap assembly extending around said pole for binding said pole and splint together to strengthen the pole;

the improvement wherein;

at least of one said strap assemblies includes, in combination, an elongated strap of relatively thin, flexible sheet metal, having a plurality of apertures formed at intervals spaced apart along the length thereof, and a clip for supporting a threaded nut element including a surface confronting an adjacent surface of said strap and at least one hook element adapted to engage said strap in at least one of said apertures to interconnect said clip and strap.

14. The improvement of claim 13, wherein:

said hook element includes a short leg extended outwardly of said surface through a selected aperture in said strap and an outer leg joining said short leg and extending along an opposite face of said strap spaced from said surface.

15. The improvement of claim 14, wherein:

said clip includes a plurality of said hook elements spaced apart by a distance substantially the same as the interval distance between adjacent apertures in said strap for engaging a plurality of selected apertures adjacent one another to form said mechanical interconnection between said strap and clip at a selected position therebetween.

16. The improvement of claim 13, wherein:

said clip includes a socket structure extending outwardly of an opposite face of said interconnected strap for removably receiving and holding a threaded element therein.

17. The improvement of claim 16, wherein:

said threaded element comprises nut means having a threaded bore aligned to receive an elongated threaded member extending in a direction generally longitudinally away from said strap.

18. In a utility pole reinforcement system of the type including an elongated pole splint driven into the ground adjacent the pole and at least a pair of tension strap assemblies spaced longitudinally apart on said splint, each strap assembly extending around said pole for binding said pole and splint together to strengthen the pole;

the improvement wherein;

at least one of said strap assemblies includes at least one pair of elongated straps of relatively thin flexible sheet metal having a plurality of apertures spaced apart at intervals longitudinally thereon, and a splicer for interconnecting adjacent ends of said strap comprising a body having opposite sides engaging adjacent faces of respective straps, said splicer including a hook element on each side, each hook element including a short leg extending outwardly through a selected aperture in an adjacent strap and an outer leg extending along a face of said strap for securing the straps in hooked engagement with said splicer extending longitudinally in opposite directions therefrom.

19. The improvement of claim 18, wherein:

said splicer body includes a plurality of longitudinally spaced apart pole engaging surfaces on at least one side thereof.

20. The improvement of claim 19, wherein:

at least one of said pole engaging surfaces comprises an outer surface of said outer leg of said hook element.

21. The utility pole reinforcement system of claim 10, wherein:

said splicer includes a pair of longitudinally spaced apart hook elements on each side of said body, each of said hook elements including a short leg projecting normally outward of said body and joined to an outer leg in spaced apart longitudinally extending relation to said body, said outer legs on each side of said body having longitudinally measured outer surface dimensions, one of which outer surface dimension is less than and the other of which outer surface dimension is greater than the width of said apertures in said strap measured longitudinally thereof.

22. The utility pole reinforcement system of claim 21, wherein:

one of said pair of hook elements on each side of said splicer body has an outer leg extended longitudinally in opposite directions from the short leg joined therewith.

23. The utility pole reinforcement system of claim 22, wherein:

the other of said pair of hook elements on each side of said splicer body has an outer leg extending longitudinally of said short leg joined therewith in only one direction but not an opposite direction.

24. The utility pole reinforcement system of claim 23, wherein:

said longitudinally extending outer legs define a throat for receiving an edge portion of an aperture on a strap engaged with said hook elements.

25. The utility pole reinforcement system of claim 21, wherein:

said outer surfaces of said outer legs of said hook elements on at least one side of said body diverge angularly outwardly away from said body to approximate tangential lines relative to the surface of a pole in contact therewith.

* * * * *